United States Patent [19]

Wysocki

[11] 4,168,003

[45] Sep. 18, 1979

[54] CARTON HAVING POUR SPOUT WITH COVER STRIP

[75] Inventor: Lawrence Wysocki, Chicago, Ill.

[73] Assignee: Champion International Corporation, Stamford, Conn.

[21] Appl. No.: 927,381

[22] Filed: Jul. 24, 1978

[51] Int. Cl.[2] ..... B65D 5/74

[52] U.S. Cl. ..... 206/611; 206/626; 229/17 R

[58] Field of Search ..... 229/17 R; 206/607, 611, 206/626

[56] References Cited

U.S. PATENT DOCUMENTS

| | | | |
|---|---|---|---|
| 1,837,750 | 12/1931 | Becker | 229/17 R |
| 1,842,237 | 1/1932 | Becker | 229/17 R |
| 1,914,543 | 6/1933 | Trost | 229/17 R |
| 1,973,960 | 9/1934 | McLaughlin | 229/17 R |
| 2,488,323 | 11/1949 | Parker | 229/17 R |
| 3,017,065 | 1/1962 | Collie | 229/17 R |
| 3,085,733 | 4/1963 | Vmanoff | 229/17 R |
| 3,096,921 | 7/1963 | Graybill | 229/17 R |
| 3,661,321 | 5/1972 | Tessmer, Jr. | 229/17 R |

*Primary Examiner*—Stephen P. Garbe

*Attorney, Agent, or Firm*—Evelyn M. Sommer

[57] ABSTRACT

A carton includes an integral pour spout formed in the top wall. A pivotable tab with flanking wing members is formed in an innermost top panel. A second top panel having an opening aligned with the tab is superimposed on the innermost panel. An outer top panel includes a tear strip which is completely or partially removable and which overlies the aligned opening and tab. When the tear strip has been at least partially removed to expose the aligned tab and opening, the tab can be pulled outwardly as the wing members fold inward to form the floor and side walls, respectively, of an integral spout. In one embodiment, a partially removable tear strip includes a small tuck flap which can be inserted through aligned openings in the inner panels to re-close the carton.

4 Claims, 5 Drawing Figures

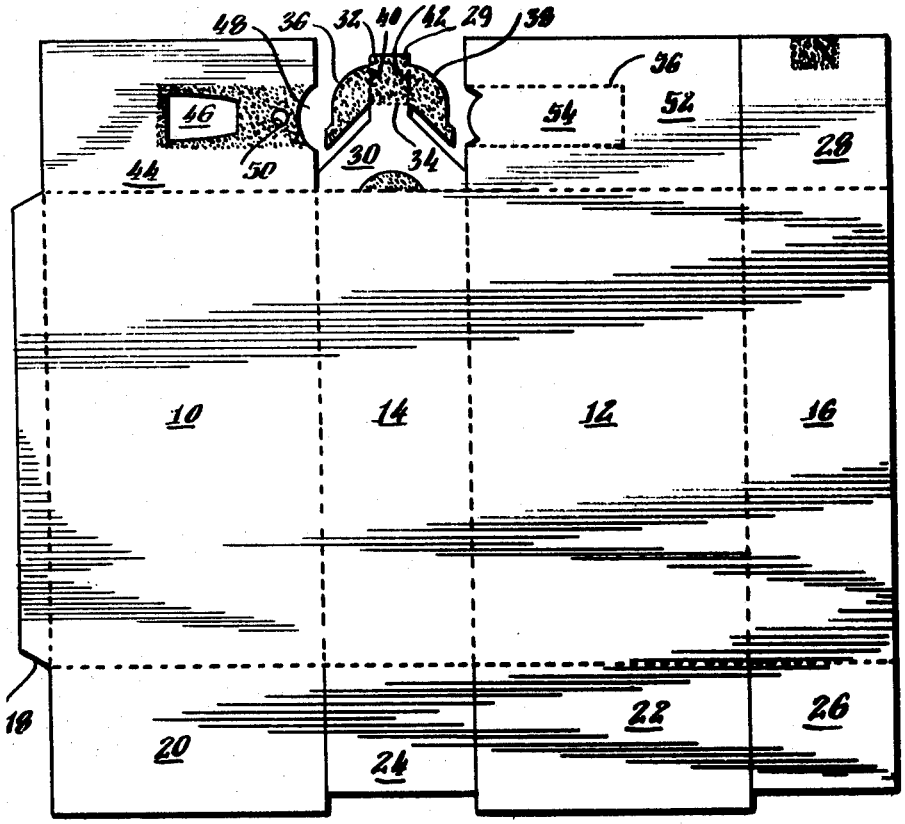
Fig. 1.
Fig. 2.
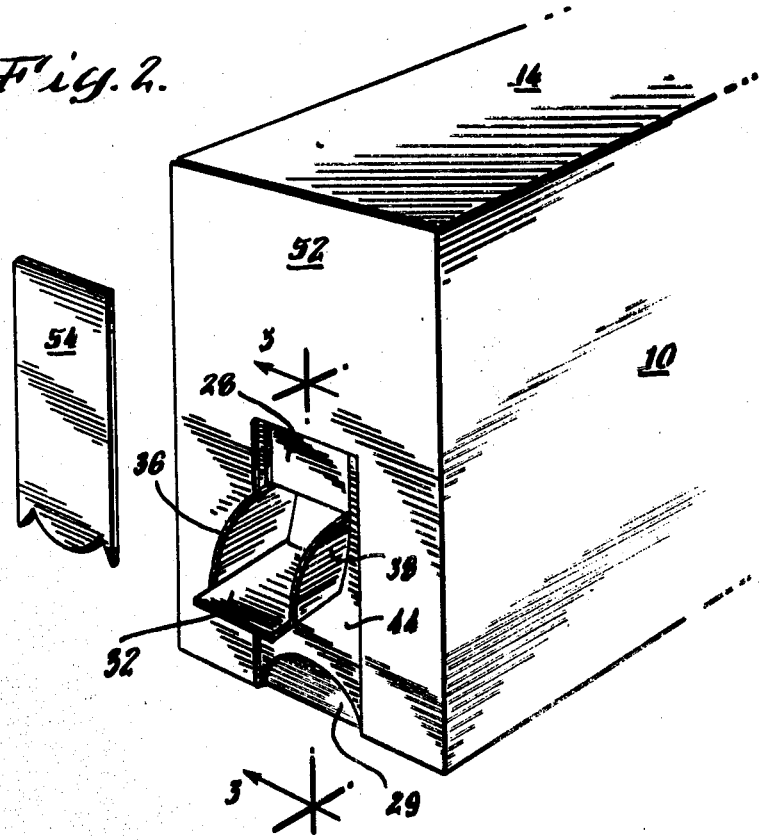
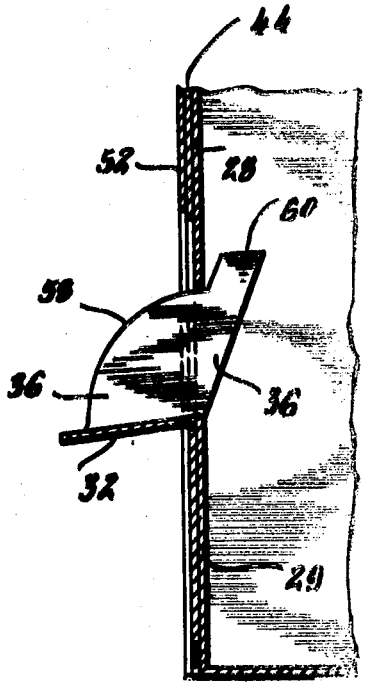
Fig. 3.

CARTON HAVING POUR SPOUT WITH COVER STRIP

BACKGROUND OF THE INVENTION

The present invention relates to containers and more particularly to a container including an integral pour spout covered by a tear strip of carton material.

A number of different kinds of granular products, such as salt, sugar, powdered detergents, etc., are marketed in containers which include pour spouts to facilitate dispensing of the material. Prior art pour spouts have been metal or plastic units which are formed separately from the container and then secured to the inner wall of the container with the spout element being aligned with an opening through the container wall.

Because the kinds of materials from which prior art spouts were formed are somewhat more expensive than the paperboard material from which the carton itself is actually formed and because of the costs associated with the separate spout manufacturing and assembly operations, prior art pour spouts have added undesirably to the overall costs of a container.

SUMMARY OF THE INVENTION

The present invention is a carton which includes an integral pour spout fabricated entirely from the carton material. The pour spout is formed when the carton itself is made, eliminating separate manufacturing operations or assembly operations. The pour spout is made from the same material as the rest of the carton to reduce the overall carton costs.

A carton constructed in accordance with the invention includes a rectangular tube formed from side wall panels connected along vertical fold lines. A bottom closure for the carton includes at least two overlapping flaps extending from the lower edges of the side wall panels. A top closure includes a first generally rectangular flap extending from an upper edge of a first side wall panel and a second flap extending from an upper edge of a second side wall panel in overlying relationship to the first flap. The second flap includes a tab connected to the flap at a fold line that parallels the upper edge of the side wall panel and flanking wing members extending outwardly from fold lines at opposite side edges of the tab. A third flap overlies the second flap. The third flap includes an opening which is aligned with the tab in the second flap. A fourth flap overlies the tab and opening in the second and third flaps. One of the third and fourth flaps is located between the first and second flaps.

DESCRIPTION OF THE DRAWINGS

While the specification concludes with claims particularly pointing out and distinctly claiming that which is regarded as the present invention, details of preferred embodiments of the invention may be more readily ascertained from the following detailed description when read in conjunction with the accompanying drawings wherein:

FIG. 1 is a plan view of a blank from which a carton including an integral spout may be formed;

FIG. 2 is a view of the blank of FIG. 1 in erected form showing the spout in its open position.

FIG. 3 is a cross sectional view taken along lines 3—3 of FIG. 2;

DETAILED DESCRIPTION

Figure 4:
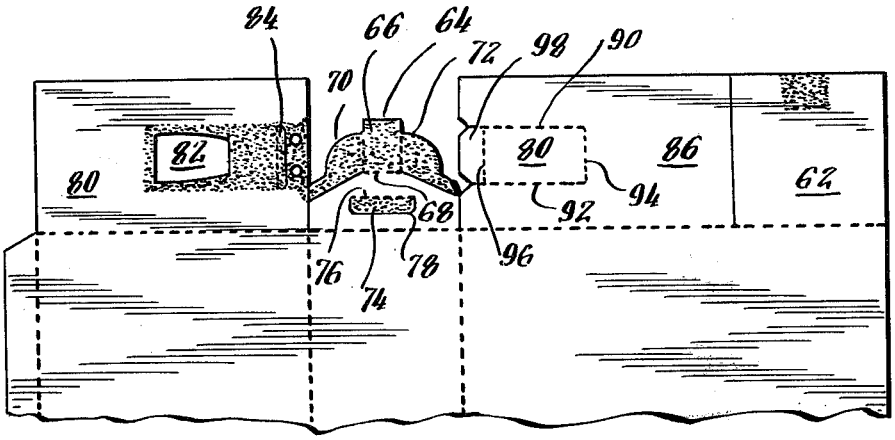
FIG. 4 is a partial plan view of a blank from which an alternate embodiment of carton may be formed.

Referring now to the drawings, and particularly to FIG. 1, a suitable one piece blank for erecting a carton with an integral pour spout has front and back panels 10 and 12, respectively, alternating with side panels 14 and 16. A relatively narrow glue flap 18 extends from the left edge of the front panel 10.

Bottom closure flaps 20 and 22 extending from the lower edge of the panels 10 and 12 are as wide as those panels and have a length substantially equal to the width of the side wall panels 14 and 16. Bottom closure flaps 24 and 26 extending from the lower edges of side panels 14 and 16, respectively, are also as wide as the panels from which they extend. The length of panels 24 and 26 is equal to or less than one half of the width of the front and back panels 10 and 12.

An integral pour spout is formed in the top wall of the carton by means of specially shaped top wall flaps. It will be noted that certain areas of the top wall flaps are cross shaded. These areas are coated with a glue retarding composition in the course of manufacturing the blank. When glue is later applied to the top flaps, those areas which have been coated with the composition remain glue-free.

Side panel 16 has a generally rectangular top flap 28 with a small glue-free area adjacent its upper edge. Side panel 14 has a top flap 29 with a generally triangular base 30 topped by a tab 32 connected to the base 30 at a fold line 34. Wing members 36 and 38 extend outwardly from fold lines 40 and 42 defining opposite side edges of the tab 32. The base 30 includes a semicircular glue-free area at its lower edge.

A top flap 44 extending from the upper edge of front panel 10 includes an opening 46 near the center of the panel and a concave recess 48 at one edge of the panel. The opening 46 and recess 48 are located within a generally rectangular glue-free area which surrounds a small area 50 to which the adhesive will adhere.

The last top flap 52 includes a tear strip 54 defined by a three sided pattern 56 of perforations extending into the panel from one edge of the flap 52. The edge of the tear strip 54 adjacent the left edge of flap 52 may be provided with a convex shape to permit it to be more readily gripped.

To erect a carton from the blank of FIG. 1, the panels 10, 12, 14, 16 and 18 are bent about the vertical fold lines to form a rectangular tube in which the adhesive-coated surface of glue flap 18 is in contact with the inner surface of panel 16.

The bottom closure for the carton is formed by first folding the flaps 24 and 26 inwardly and then folding the flaps 20 and 22 inwardly, one at a time. The flaps 20 and 22 are secured to one another in a conventional manner by a suitable adhesive on one of the facing flap surfaces.

After the carton is filled, the top closure is formed by first folding flaps 28 and 29 inwardly in sequence. The heights of flaps 28 and 29 are such that the upper edge of tab 32 on flap 29 will overlap flap 28, resting on the glue-free area adjacent the edge of flap 28. The overlap prevents the tab from being pushed into the carton.

Then, flap 44 is folded into overlying contact with the flaps 29 and 28. Adhesive on the top surfaces of flaps 28 and 29 bonds these flaps to the bottom surfaces of flap 44. The opening 46 in flap 44 is generally aligned with tab 32 in flap 29. Finally, flap 52 is folded into place with tear strip 54 overlying the glue-free area on flap 44. The convex end of tear strip 54 is in registry with the convex recess 48 in the flap 44.

Referring specifically to FIG. 2, the carton erected from the blank of FIG. 1 is shown with the tear strip 54 completely removed from flap 52. When the tab 32 is pulled outwardly through the opening 46, the wing members 36 and 38 are bent upward or toward one another as they rub along the edges of the opening 46. The inner surface of tab 32 forms the floor of a spout while the wing members 36 form the spout side walls. Referring to FIG. 3, each of the wing members preferably includes an arcuate edge 58 which rides along or at least near the outer edge of flap 28 as the spout is being opened. Each arcuate edge 58 ends in a projection 60 which comes into contact with the inner surface of flap 28 to limit outward movement of the spout.

Figure 5:
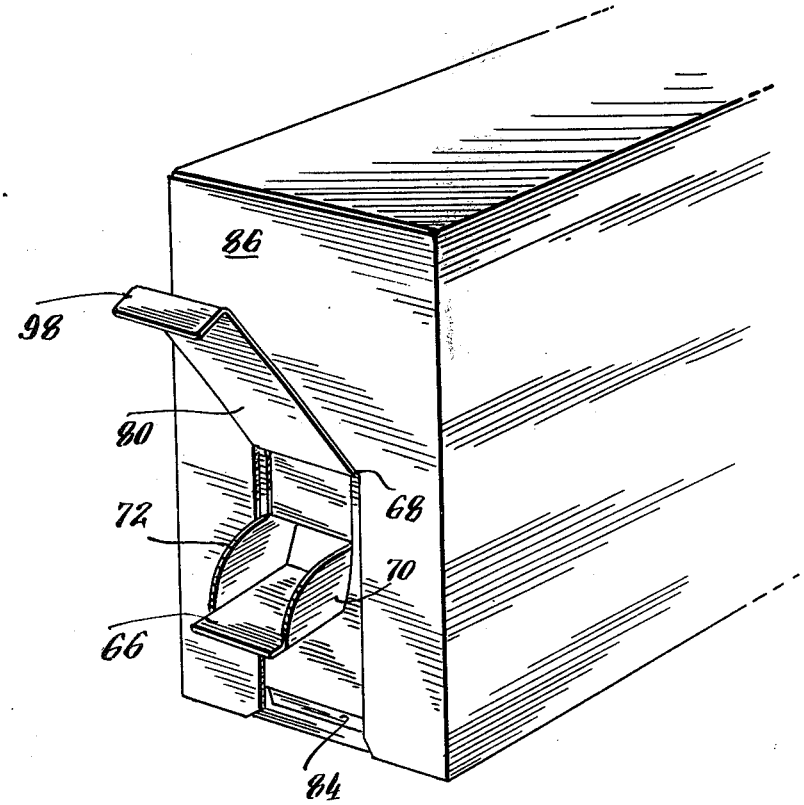
FIG. 5 is a partial perspective view of a carton erected from the blank of FIG. 4.

In the embodiment of the invention described with reference to FIGS. 1–3 above, the tear strip is a completely removable one. It may be advantageous to provide a partially removable tear strip which can be used in re-closing the carton. Such a carton is described with reference to FIGS. 4 and 5. The carton blank includes a rectangular top flap 62 with a glue-free area adjacent one edge. Another top flap 64 includes a tab 66 which can be pivoted about fold line 68 and which is flanked by wing members 70 and 72. The flap 64 further includes a relatively narrow D-shaped flap 74 defined by a straight fold line 76 and a curved score line 78.

A top flap 80 includes an opening 82 in a glue free area and a second D-shaped flap 84 similar to flap 74. The fourth top flap 86 includes a tear strip 88 having two sides 90 and 92 defined by perforations and a third side defined by a fold line 94. The tear strip 88 has a second fold line 96 near its outer edge defining an inner edge of a short tuck flap 98.

A carton is erected from this blank in the same manner in which a carton is erected from the blank of FIG. 1. In this carton, however, the tear strip is not completely removed from the carton when first used but instead is folded about the fold line 68. When a consumer is finished using the carton, the spout formed by tab 66 and wing members 70 and 72 can be closed and the tear strip 88 returned towards its original position. The tuck flap 98 is guided into the opening formed by the aligned D-shaped flaps 74 and 84. The natural resiliency of the D-shaped flap material produces a friction fit between the tuck flap 98 and the carton to provide an effective closure.

While there have been described what are considered to be preferred embodiments of the inventions, variations and modifications therein will occur to those skilled in the art once they become acquainted with the invention. Therefore, it is intended that the appended claims shall be construed to include all such variations and modifications as fall within the true spirit and scope of the invention.

What is claimed is:

1. A carton including:

a rectangular tube comprising side wall panels connected along vertical fold lines;

a bottom closure comprising at least two overlapping flaps extending from the lower edges of said side wall panels; and a top closure comprising a first rectangular flap extending generally perpendicularly from an upper edge of a first one of said side wall panels, a second flap extending generally perpendicularly from an upper edge of a second one of said wall panels in overlying relationship to said first flap, said second flap including a tab member connected to the flap at a fold line paralleling the upper edge of the side wall panel and wing members extending outwardly from fold lines defining the opposite side edges of said tab member, a third flap extending generally perpendicularly from an upper edge of a third one of said side wall panels in overlying relationship to said second flap, said third flap including an opening therethrough aligned with said tab member, said opening being slightly wider than said tab member, and a fourth flap extending generally perpendicularly from an upper edge of a fourth one of said side wall panels in overlying relationship to said third flap, said fourth flap including a generally rectangular tear strip overlying said tab member and opening, one of said third and fourth flaps being intermediate said first and second flaps, said tear strip being partially removable, remaining connected to said fourth flap at a fold line defining one edge of said tear strip, each of said third and fourth flaps further including a narrow, generally D-shaped flap defined by a straight fold line and a curved score line, said D-shaped flaps being aligned with each other;

said tear strip further including a relatively short tuck flap adjacent its free end, said tuck flap being receivable in an opening formed by deforming the aligned D-shaped flaps inwardly.

2. A blank for a carton which includes an integral covered pour spout in its erected form, said blank comprising:

a plurality of rectangular side wall panels formed by subdividing a larger rectangular panel with spaced vertical fold lines;

a plurality of rectangular bottom closure flaps, each of said flaps extending from a fold line defining a lower edge of one of said side wall panels; and a plurality of top closure flaps, each extending from a fold line defining an upper edge of one of said side wall panels, said top closure flaps including a first rectangular flap, a second flap including a tab member connected to said flap at a fold line and wing members extending from fold lines defining opposite edges of said tab member, a third flap having an opening therethrough, and a fourth flap including perforations defining a tear strip terminating at one edge of said fourth flap, one of said third and fourth flaps being intermediate said first and second flaps, said tear strip being defined by parallel rows of perforations extending from one edge of said fourth flap and by a fold line connecting said rows of perforations at a point spaced from said flap edge, each of said second and third flaps further including a narrow, generally D-shaped flap defined by a straight fold line and a curved score line.

3. A blank as recited in claim 2 wherein said tear strip includes a second fold line parallel to the edge of said fourth flap, said second fold line defining the inner edge of a relatively short tuck flap at the outer end of the tear strip.

4. A blank as recited in claim 3 wherein each of said wing members on said second flap includes an arcuate edge and a projection at the edge of the wing member remote from the tab member.

* * * * *